US008647037B2

(12) United States Patent
Bhat et al.

(10) Patent No.: US 8,647,037 B2
(45) Date of Patent: Feb. 11, 2014

(54) SYSTEM AND METHOD FOR ASSEMBLING AN END COVER OF A COMBUSTOR

(75) Inventors: Arunkant Ramdas Bhat, Simpsonville, SC (US); Keith Cletus Belsom, Laurens, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/461,034

(22) Filed: May 1, 2012

(65) Prior Publication Data

US 2013/0294864 A1 Nov. 7, 2013

(51) Int. Cl.
*F16B 33/00* (2006.01)

(52) U.S. Cl.
USPC ..... 411/366.1; 411/383

(58) Field of Classification Search
USPC ..... 411/204–206, 208, 209, 315, 338, 411/366.1, 383, 386; 29/259, 264; 292/251, 292/256, 256.71, 256.73, DIG. 11
See application file for complete search history.

(56) References Cited

U.S. PATENT DOCUMENTS

| | | | | | |
|---|---|---|---|---|---|
| 447,775 | A | * | 3/1891 | Higbee | 411/436 |
| 1,074,551 | A | * | 9/1913 | Klenk | 411/209 |
| 1,414,979 | A | * | 5/1922 | Carter | 411/366.1 |
| 1,493,442 | A | * | 5/1924 | Swain | 301/22 |
| 3,416,823 | A | * | 12/1968 | Auer | 403/408.1 |
| 6,052,274 | A | | 4/2000 | Remsburg | |
| 6,141,862 | A | | 11/2000 | Matsui et al. | |
| 6,931,855 | B2 | | 8/2005 | Glessner et al. | |
| 7,134,287 | B2 | | 11/2006 | Belsom et al. | |
| 7,338,244 | B2 | | 3/2008 | Glessner et al. | |
| 7,669,424 | B2 | | 3/2010 | Thornton | |
| 2002/0182030 | A1 | * | 12/2002 | Hamada et al. | 411/366.1 |

* cited by examiner

*Primary Examiner* — Roberta Delisle
(74) *Attorney, Agent, or Firm* — Dority & Manning, PA

(57) ABSTRACT

A system for assembling an end cover of a combustor includes a connector and structure for engaging the connector to an insert positioned at least partially inside the end cover. The system also includes structure for moving the connector axially with respect to the end cover. A method for assembling an end cover of a combustor includes inserting a connector through at least a portion of the end cover and an insert positioned at least partially inside the end cover. The method further includes engaging the connector with the insert and moving the connector axially with respect to the end cover to compress the insert against the end cover.

9 Claims, 9 Drawing Sheets

SYSTEM AND METHOD FOR ASSEMBLING AN END COVER OF A COMBUSTOR

FIELD OF THE INVENTION

The present invention generally involves a system and method for assembling an end cover of a combustor.

BACKGROUND OF THE INVENTION

Combustors are known in the art for igniting fuel with air to produce combustion gases having a high temperature and pressure. For example, gas turbine systems, aircraft engines, and numerous other combustion-based systems may include one or more combustors that mix a working fluid, such as air, with fuel and ignite the mixture to produce high temperature and pressure combustion gases. The combustion gases may then be used to rotate a turbine, provide thrust, or perform various other forms of work.

Each combustor may include an end cover that provides an interface for supplying multiple fuels, diluents, and/or additives to fuel nozzles inside the combustor. The end cover may include multiple internal fluid passages, and an insert may be installed between the end cover and each fuel nozzle to connect the different fluid passages inside the end cover to corresponding fluid passages inside the fuel nozzles. In this manner, a single end cover design may be adapted to fit multiple fuel nozzle designs.

Various seals, such as the seals disclosed in U.S. Pat. No. 7,134,287 and assigned to the same assignee as the present invention, may be installed between the end cover and the insert to prevent leakage between the various fluid passages inside the end cover and the insert. During manufacture and assembly, screws, bolts, joints, or other fasteners may be used to hold the insert and seals in place with respect to the end cover so that the assembly may be leak tested, shipped, and otherwise held together. The specific type, size, and location of the fasteners involves several competing design considerations. For example, multiple smaller fasteners may be used around the circumference of the insert to ensure a relatively consistent force is applied to each seal. However, the use of multiple fasteners to attach the insert to the end cover necessarily increases the number of parts, machining, and time associated with assembling and testing the end cover. In addition, the available surface area of the end cover limits the number and size of the fasteners between the insert and the end cover. Therefore, an improved system and method for assembling an end cover of a combustor that reduces the number of parts, machining, assembly time, and/or required surface area on the end cover would be useful.

BRIEF DESCRIPTION OF THE INVENTION

Aspects and advantages of the invention are set forth below in the following description, or may be obvious from the description, or may be learned through practice of the invention.

One embodiment of the present invention is a system for assembling an end cover of a combustor. The system includes a connector and means for engaging the connector to an insert positioned at least partially inside the end cover. In addition, the system includes means for moving the connector axially with respect to the end cover.

Another embodiment of the present invention is a system for assembling an end cover of a combustor that includes a connector, a first end of the connector configured to engage with an insert positioned at least partially inside the end cover, and a second end of the connector opposed to the first end. At least one of a cam or a nut is engaged with the connector between the second end and the end cover.

The present invention also includes a method for assembling an end cover of a combustor that includes inserting a connector through at least a portion of the end cover and inserting the connector through at least a portion of an insert positioned at least partially inside the end cover. The method further includes engaging the connector with the insert and moving the connector axially with respect to the end cover to compress the insert against the end cover.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
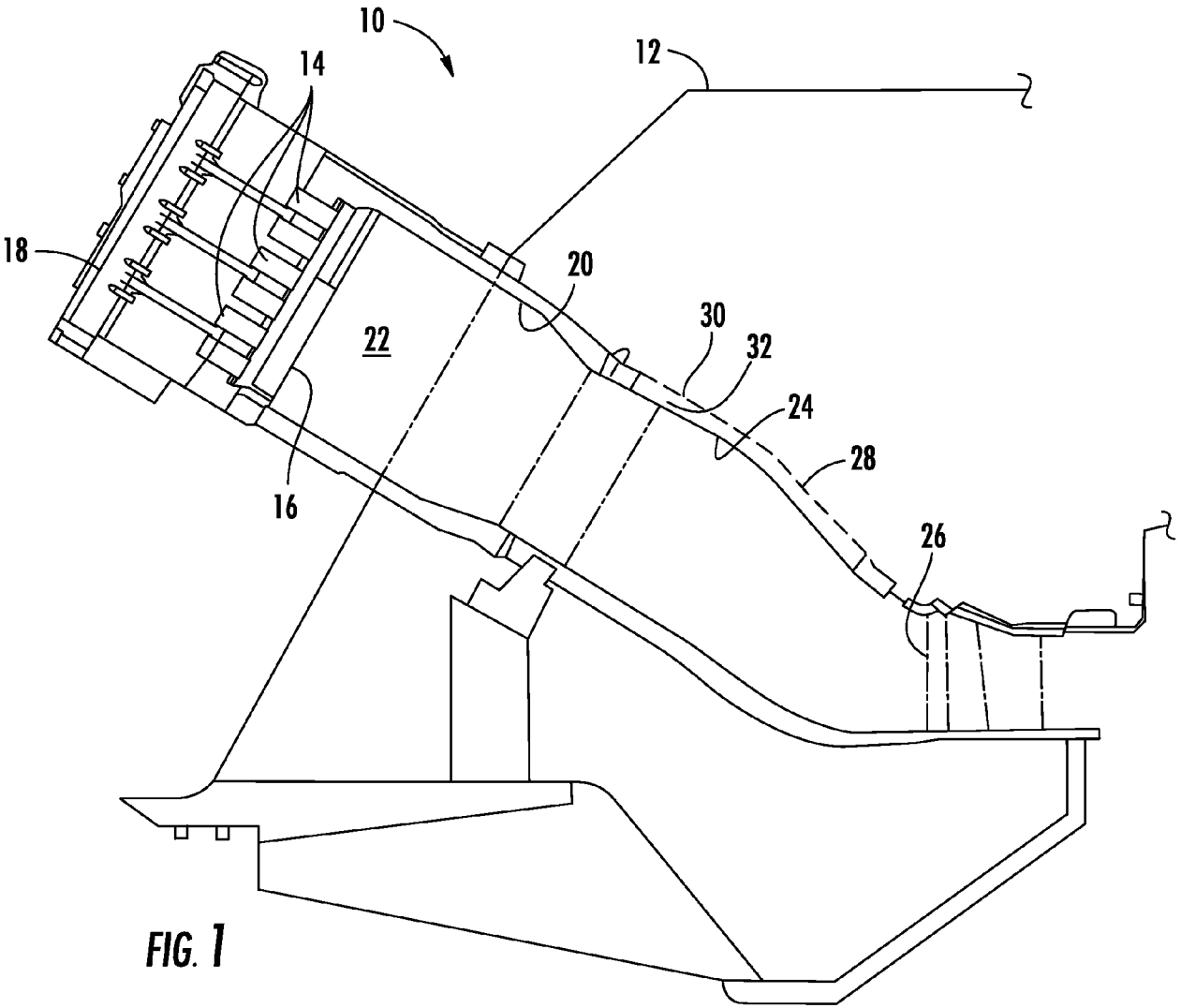
FIG. 1 is a simplified cross-section view of an exemplary combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system and method for assembling an end cover of a combustor. In particular embodiments, the system and method may provide a re-usable kit that may hold an insert and seals in place with respect to the end cover to facilitate testing, shipment, installation, and/or maintenance of the end cover in the combustor. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 shows a simplified cross-section view of an exemplary combustor 10, such as would be included in a gas turbine, according to one embodiment of the present invention. A casing 12 may surround the combustor 10 to contain a working fluid flowing to the combustor 10. One or more fuel nozzles 14 may be radially arranged between a top cap 16 and an end cover 18. Various embodiments of the combustor 10 may include different numbers and arrangements of fuel nozzles 14. The top cap 16 and a liner 20 generally surround a combustion chamber 22 located downstream from the fuel nozzles 14, and a transition piece 24 downstream from the liner 20 connects the combustion chamber 22 to a turbine inlet 26.

An impingement sleeve 28 with flow holes 30 may surround the transition piece 24 to define an annular passage 32 between the impingement sleeve 28 and the transition piece 24. The compressed working fluid may pass through the flow holes 30 in the impingement sleeve 28 to flow through the annular passage 32 to provide convective cooling to the transition piece 24 and liner 20. When the compressed working fluid reaches the end cover 18, the compressed working fluid reverses direction to flow through one or more of the fuel nozzles 14 where it mixes with fuel before igniting in the combustion chamber 22 to produce combustion gases having a high temperature and pressure.

Figure 2:
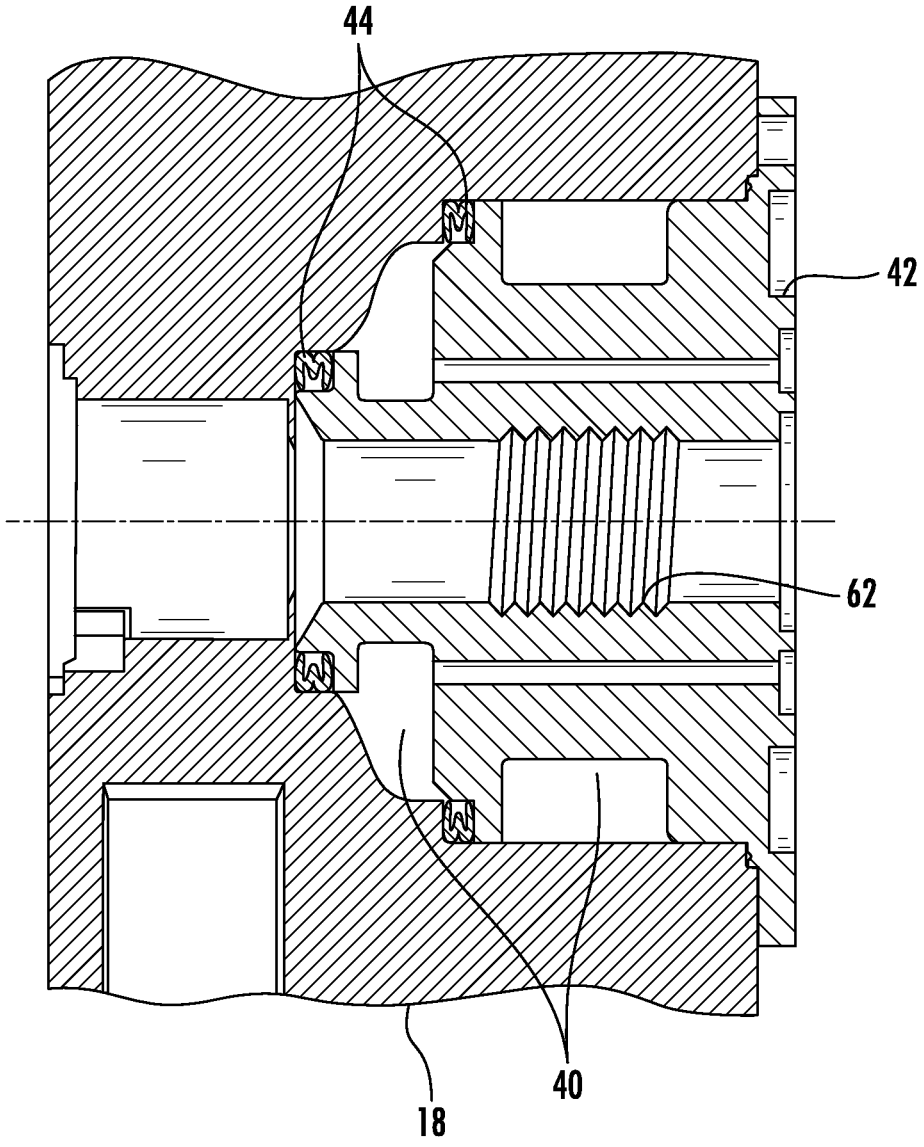
FIG. 2 is a side cross-section view of a portion of the end cover shown in FIG. 1.

FIG. 2 provides a side cross-section view of a portion of the end cover 18 shown in FIG. 1. The end cover 18 includes one or more internal fluid passages 40 that provide fluid communication through the end cover 18 to the fuel nozzles 14. An insert 42 may be installed between the end cover 18 and each fuel nozzle 14 to connect the different fluid passages 40 inside the end cover 18 to corresponding fluid passages inside the fuel nozzles 14. As shown in FIG. 2, seals 44 may be installed between the end cover 18 and the insert 42 to prevent leakage between the various fluid passages 40 inside the end cover 18 and the insert 42. The seals 44 may include annular rings having a c-shape or a w-shape as is known in the art to readily flex in response to relative movement between the insert 42 and the end cover 18.

Figure 3:
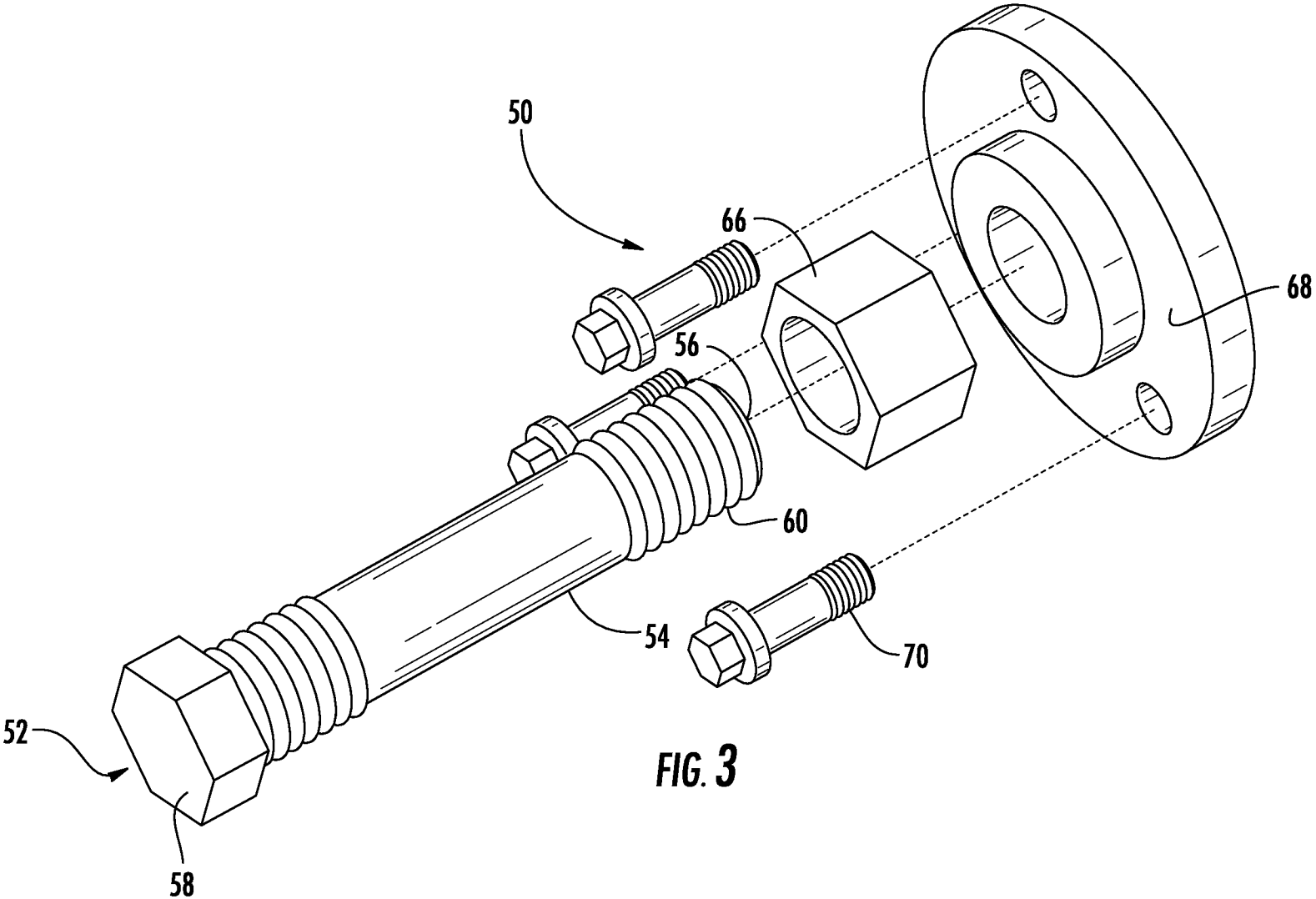
FIG. 3 is an exploded perspective view of a system for assembling an end cover of a combustor according to a first embodiment of the present invention.

FIG. 3 provides an exploded perspective view of a system 50 for assembling the end cover 18 according to a first embodiment of the present invention. The system generally includes a connector 52, means for engaging the connector 52 to the insert 42, and means for moving the connector 52 axially with respect to the end cover 18. The connector 52 may include a rod 54, cylinder, shaft, or other structural member that fits at least partially inside the end cover 18 and/or insert 42 and is suitable for engaging with the insert 42. For example, in the particular embodiment shown in FIG. 3, the connector 52 may include first and second ends 56, 58 opposed to one another with threads 60 proximate to the first end 56. The threads 60 proximate to the first end 56 may be configured to engage with complementary threads 62 inside the insert 42.

The means for engaging the connector 52 to the insert 42 may include any fastener, complementary surfaces, or other suitable feature known to one of ordinary skill in the art for connecting or engaging components together. As shown in FIGS. 4-8, for example, the means for engaging the connector 52 to the insert 42 may include a threaded engagement 64 between the connector 52 and the insert 42. In alternate embodiments, the structure for the means may include a press fit, a clamp, glue, or other suitable device for coupling the connector 52 to the insert 42.

The means for moving the connector 52 axially with respect to the end cover 18 may similarly include any device capable of providing a mechanical advantage to move the connector 52 axially with respect to the end cover 18. As shown in FIG. 3, for example, the means for moving the connector 52 axially with respect to the end cover 18 may include a nut 66 in threaded engagement with the connector 52 so that rotation of the nut 66 will move the connector 52 axially with respect to the end cover 18. In alternate embodiments, the structure associated with moving the connector 52 axially with respect to the end cover 18 may include, for example, a hydraulic tensioner, shim, cam, or other suitable device.

In the particular embodiment shown in FIG. 3, the system 50 may further include a flange 68 between the second end 58 of the connector 52 and the end cover 18. The flange 68 may extend radially across the end cover 18 to protect the surface of the end cover 18 from abrasion or other damage that may be caused by the means for moving the connector 52 axially with respect to the end cover 18. In addition, the bolt head on the second end 58 may facilitate loosening or removal of the connector 52 in the event the connector 52 becomes excessively bound to the insert 42. As further shown in FIG. 3, the system 50 may include means for connecting the flange 68 to the end cover 18. The structure for connecting the flange 68 to the end cover 18 may include, for example, an adhesive, a screw, or a bolt 70, as shown in FIG. 3, that provides a releasable connection between the flange 68 and the end cover 18.

Figure 4:
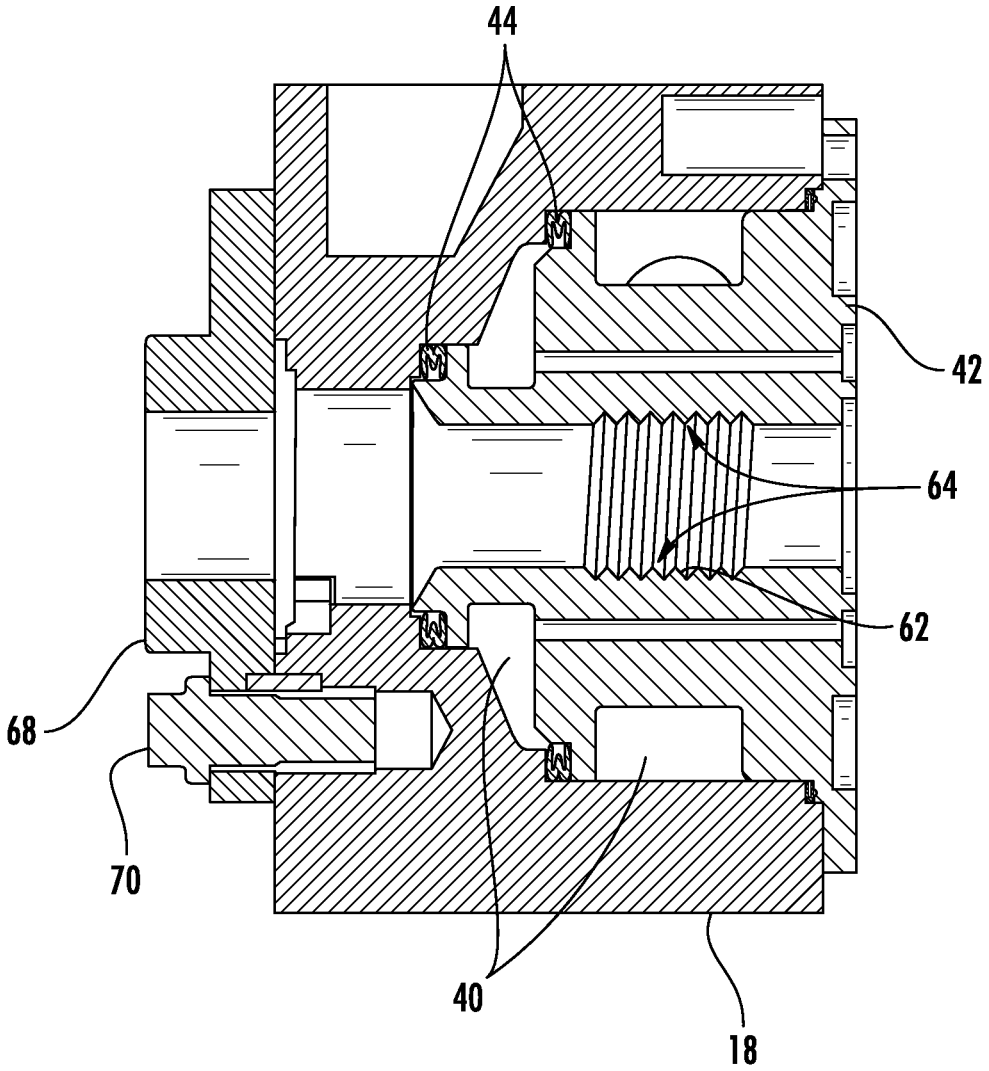
FIG. 4 is a side cross-section view of the end cover shown in FIG. 2 with the system shown in FIG. 3 partially installed.

FIGS. 4-8 provide various cross-section views of the system 50 shown in FIG. 3 being used to assemble the end cover 18 shown in FIG. 2. As shown in FIG. 4, the insert 42 has been placed inside at least a portion of the end cover 18, with the seals 44 between the insert 42 and the end cover 18. As previously discussed, the insert 42 includes the complementary threads 62 that are configured to provide the threaded engagement 64 with the threads 60 on the connector 52. In the particular embodiment shown in FIG. 4, system 50 includes the optional flange 68, and the bolt 70 connects the flange 68 to the end cover 18.

Figure 5:
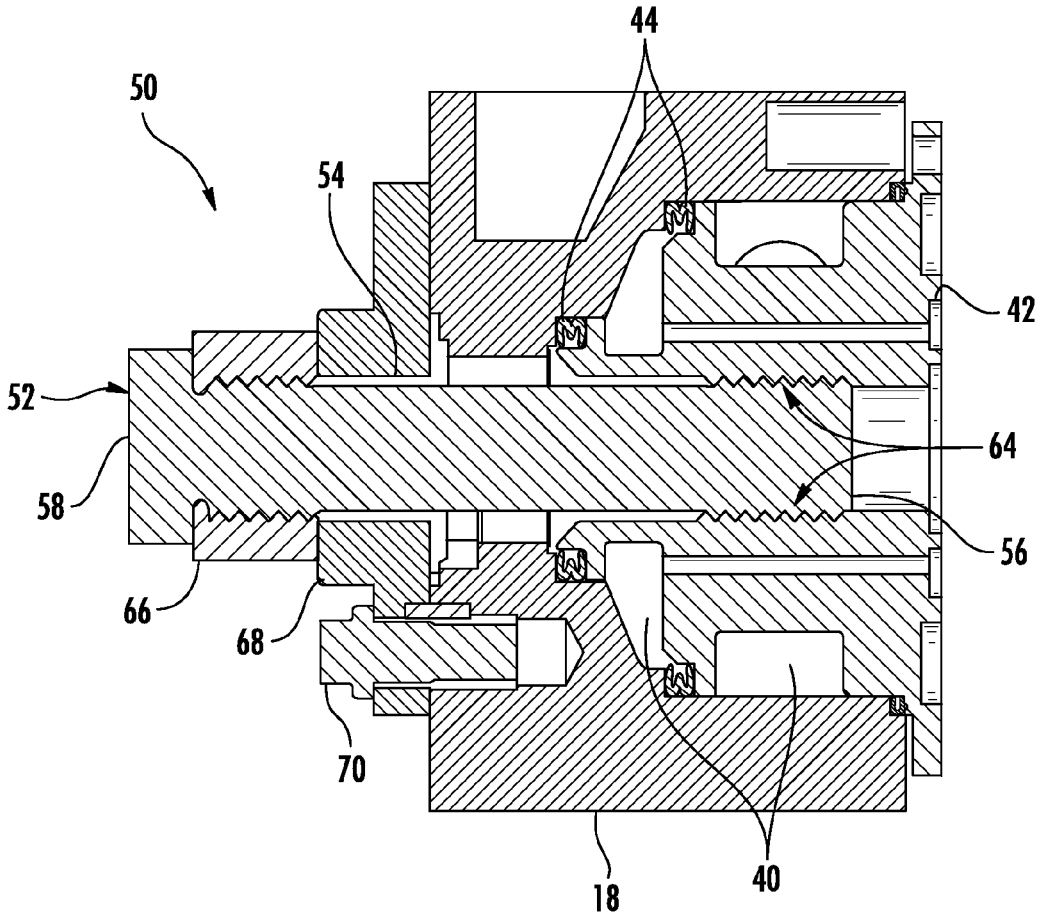
FIG. 5 is a side cross-section view of the end cover shown in FIG. 2 with the system shown in FIG. 3 installed.
Figure 6:
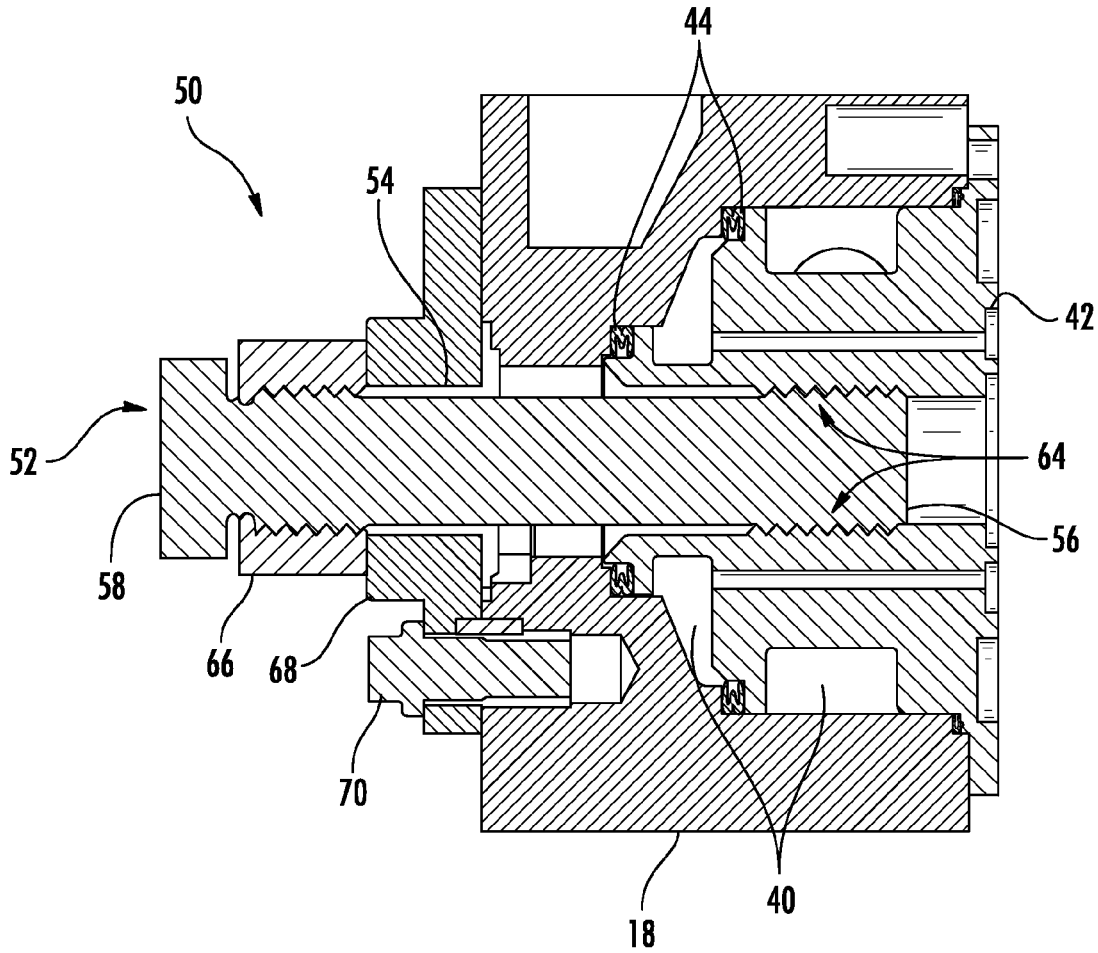
FIG. 6 is a side cross-section view of the end cover shown in FIG. 2 with the system shown in FIG. 3 installed and tightened.

As shown in FIG. 5, the nut 66 has been threaded onto the connector 52, and the connector has been inserted through the flange 68 and at least partially into the end cover 18 and the insert 42. When the threads 60 on the connector 52 reach the threads 62 on the insert 42, the connector 52 may be rotated to engage the connector 52 to the insert 42. The resulting threaded engagement 64 between the connector 52 and the insert 42 draws the insert 42 snugly into or toward the end cover 18 to hold the insert 42 and seals 44 firmly in place. Although the connector 52 may be rotated further to more firmly compress the insert 42 to the end cover 18, excessive snubbing at the threaded engagement 64 may produce undesirable galling between the connector 52 and the insert 42. As a result, the means for moving the connector 52 axially with respect to the end cover 18 may be actuated to more firmly engage the insert 42 to the end cover 18. In the particular embodiment shown in FIG. 6, for example, the nut 66 may be rotated to move the connector 52 axially with respect to the end cover 18 to compress the insert 42 against the end cover 18.

Figure 7:
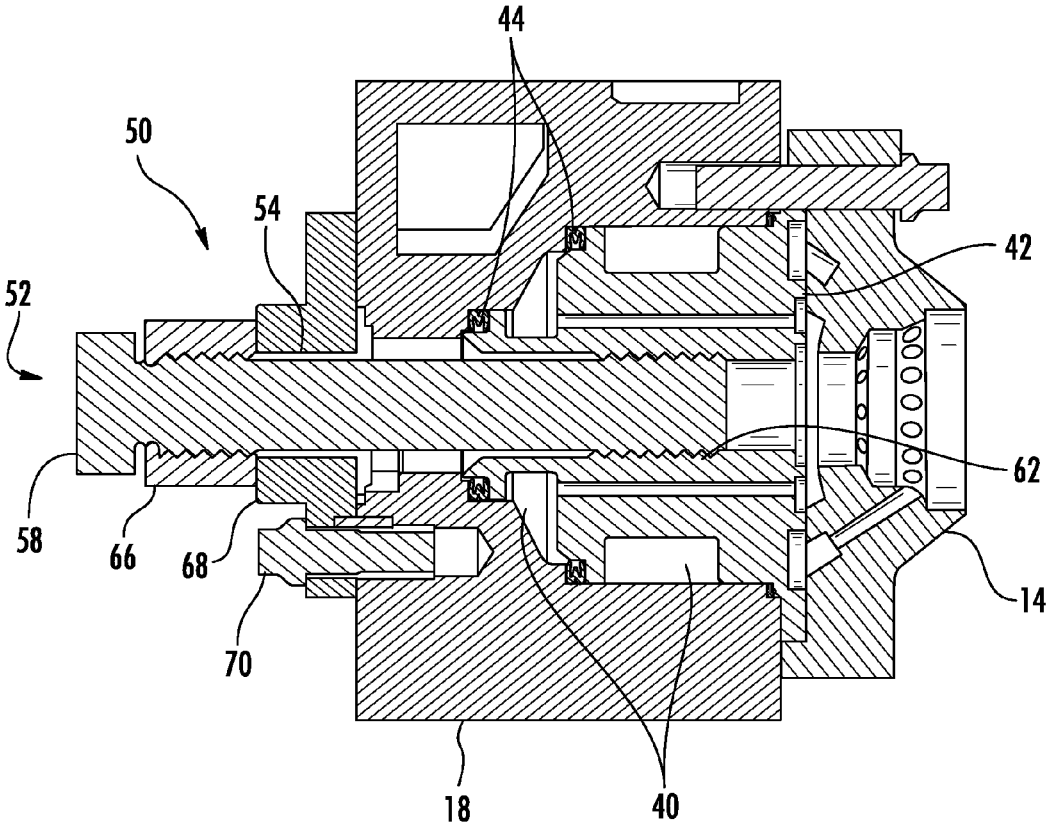
FIG. 7 is a side cross-section view of the end cover shown in FIG. 2 with the system shown in FIG. 3 installed and tightened and a fuel nozzle installed.
Figure 8:
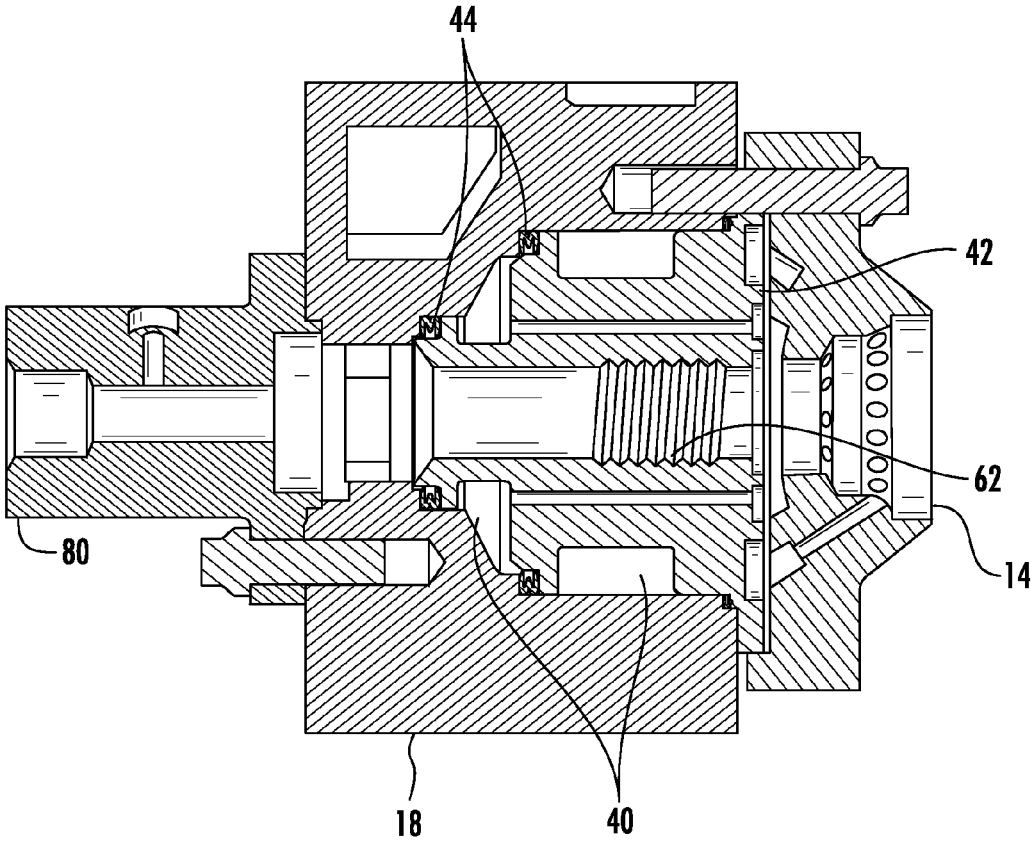
FIG. 8 is a side cross-section view of the end cover shown in FIG. 2 with the fuel nozzle and a fuel cartridge installed.

In FIG. 7, the fuel nozzle 14 has been bolted or otherwise connected to the interior of the end cover 18 to sandwich the insert 42 against the end cover 18 to hold the insert 42 and seals 44 firmly in place with respect to the end cover 18. As a result, the system 50 shown in FIG. 7 is no longer necessary and may be removed. As shown in FIG. 8, the connector 52 has been removed from the insert 42, and the flange 68 has been removed from the end cover 18. In addition, a fuel cartridge 80 has been installed on the outside of the end cover 18 to supply fuel, diluents, and/or other additives through the end cover 18 and insert 42 to the fuel nozzle 14. In the event that subsequent maintenance requires removal of the fuel nozzle 14, the fuel cartridge 80 may be removed and the system 50 may be re-installed to again hold the insert 42 and seals 44 in place with respect to the end cover 18.

Figure 9:
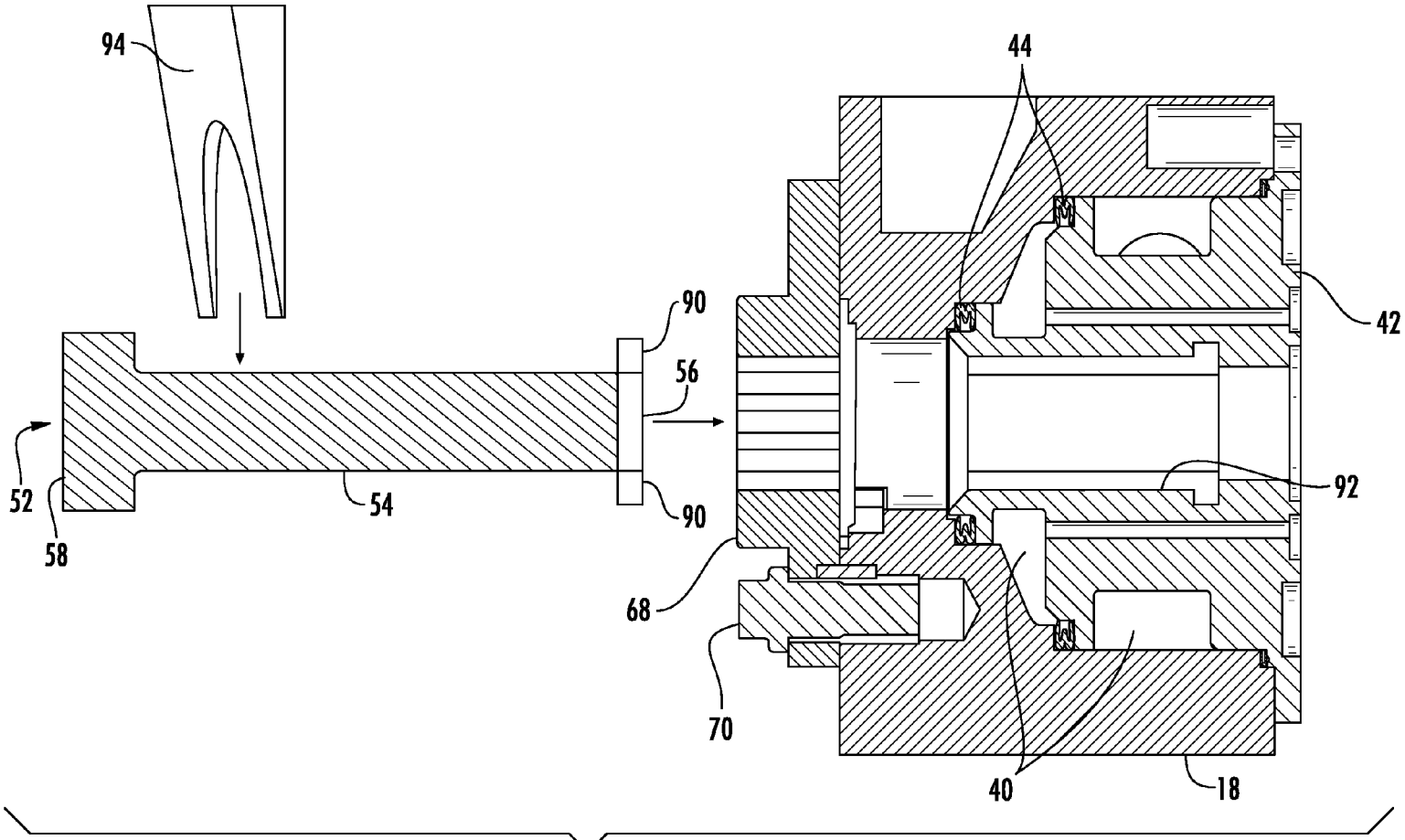
FIG. 9 is a side cross-section view of the end cover shown in FIG. 2 with the system for assembling the end cover according to a second embodiment of the present invention.

FIG. 9 provides a side cross-section view of the end cover 18 shown in FIG. 2 with the system 50 for assembling the end cover 18 according to a second embodiment of the present invention. In this particular embodiment, the means for engaging the connector 52 to the insert 42 includes a plurality of radially extending fingers, projections, splines, or keys 90 proximate to the first end 56 of the connector 52. The splines or keys 90 are configured to slide inside complementary grooves 92 in the insert 42, and rotation of the connector 52 engages the splines or keys 90 inside the insert 42. In addition, the means for moving the connector 52 axially with respect to the end cover 52 may include a shim or cam 94 engaged with the connector 52 between the second end 58 and the end cover 18. Specifically, the cam 94 may be moved between the connector 52 and the end cover 18 to drive the connector 52 axially with respect to the end cover 18. Although not shown in FIG. 9, one of ordinary skill in the art will readily appreciate from the teachings herein that the second embodiment may further include the flange 68 and/or bolt 70 for connecting the flange 68 to the end cover 18, as previously described with respect to the embodiment shown in FIGS. 3-7.

The system 50 and method disclosed herein provides several benefits over existing technology. For example, the systems 50 shown and described with respect to FIGS. 3-9 obviate the need for multiple screws, joints, fasteners, or other parts previously used to hold the insert 42 and seals 44 in place. The single compressive force provided by the system 50 acting at the center of the insert 42 results in more uniform compressive force on the seals 44 that enhance consistent seal 44 performance. In addition, since the system 50 is only needed until the fuel nozzle 14 and/or cartridge 80 are installed, the system 50 may provide a temporary device that can be re-used with other end covers 18, resulting in cost savings. Lastly, the systems 50 described herein do not require additional machining of the end cover 18 or take up the limited space on the end cover 18. As a result, the time required to assemble and/or disassemble the end cover 18 may be greatly reduced, providing substantial savings in labor and undesirable outages. These and other advantages may be realized upon practice of the various embodiments described herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for coupling an insert to an end cover of a combustor, comprising;

a. an end cover defining an outer surface, an inner surface and a borehole;

b. an insert disposed partially within the borehole, the insert defining one or more fluid passages in fluid communication with the borehole and a center passage; and c. a system for coupling the insert to the end cover, the system comprising:

i. a flange disposed adjacent to the outer surface, the flange defining an annular passage aligned with the borehole and the center passage of the insert;

ii. a connector having a first end and an opposing second end, the first end configured to engage with the insert and a second end configured for actuating the connector axially, the connector extending through the flange into the into the center passage of the insert; and iii. wherein the first end of the connector is engaged with the insert.

2. The system as in claim 1, wherein the connector comprises a rod extending between the first and second ends.

3. The system as in claim 1, wherein the first end of the connector comprises threads in threaded engagement with the center passage of the insert.

4. The system as in claim 1, further comprising one or more bolts, wherein the one or more bolts extend through the flange into the end cover.

5. The system as in claim 1, further comprising a releasable connection between the flange and the end cover.

6. The system as in claim 1, further comprising a nut disposed between the second end of the connector and an outer surface of the flange, wherein the nut is in threaded engagement with the connector.

7. The system as in claim 1, wherein the nut is configured to move the connector axially with respect to the end cover.

8. The system as in claim 1, wherein the first end comprises one or more radially extending splines or keys and the insert comprises a complementary groove.

9. The system as in claim 8, further comprising at least one of a shim or a cam disposed between the second end of the connector and an outer surface of the flange.

* * * * *